US010934675B2

(12) United States Patent
Wu

(10) Patent No.: US 10,934,675 B2
(45) Date of Patent: Mar. 2, 2021

(54) SOIL DRAINAGE DEVICE

(71) Applicant: Fa-Te Wu, Taipei (TW)

(72) Inventor: Fa-Te Wu, Taipei (TW)

( * ) Notice: Subject to any disclaimer, the term of this patent is extended or adjusted under 35 U.S.C. 154(b) by 0 days.

(21) Appl. No.: 16/863,556

(22) Filed: Apr. 30, 2020

(65) Prior Publication Data

US 2020/0354911 A1 Nov. 12, 2020

(30) Foreign Application Priority Data

May 6, 2019 (TW) ..... 108205564

(51) Int. Cl.
*E02B 11/00* (2006.01)
*E02B 11/02* (2006.01)

(52) U.S. Cl.
CPC ..... *E02B 11/02* (2013.01); *E02B 11/005* (2013.01)

(58) Field of Classification Search
CPC ..... E02B 11/00; E02B 11/005
USPC ..... 405/36
See application file for complete search history.

(56) References Cited

U.S. PATENT DOCUMENTS 4,948,294 A * 8/1990 Mercier ..... E02B 11/00 405/36
2007/0251877 A1* 11/2007 Chang ..... E02B 11/005 210/338
2013/0213869 A1* 8/2013 Allard ..... E02D 27/32 210/170.03
2014/0377009 A1* 12/2014 Lacazedieu ..... E03F 5/18 405/129.7

* cited by examiner

*Primary Examiner* — Sean D Andrish
(74) *Attorney, Agent, or Firm* — Hamre, Schumann, Mueller & Larson, P.C.

(57) ABSTRACT

A soil drainage device includes a host, at least one water collecting assembly and a piping unit. The host includes a host housing for receiving a control module and an air pump. The water collecting assembly includes an assembly housing defining a water collecting chamber and a water reservoir chamber, and having an upper penetrating bore and a plurality of openings for entering of water into the water collecting chamber through a filter unit. The water flows into and is stored in the water reservoir chamber. At least one air conducting pipe is disposed to introduce compressed air from the air pump into the water reservoir chamber to form a pressure so as to force water flow out of the water reservoir chamber through a water draining pipe.

9 Claims, 7 Drawing Sheets

SOIL DRAINAGE DEVICE

CROSS-REFERENCE TO RELATED APPLICATION

This application claims priority of Taiwanese Patent Application No. 108205564, filed on May 6, 2019.

FIELD

The disclosure relates to a soil drainage device, and more particularly to a soil drainage device which can extract water or fluids from soil to regulate moisture of the soil.

BACKGROUND

Water drainage from soil is essential for preventing water ponding on the ground surface which causes breeding habitat of vector mosquitoes, and excess water in soil which causes problems such as plant root rot, poor growth and even death. A conventional approach for extracting water from soil surface is natural infiltration and evaporation, which is inefficient and time consuming. Another approach is to use a drainage ditch, or a vent pipe buried therein to increase the evaporation rate. It is troublesome to build a drainage ditch at low-lying areas and use a vent pipe at a cement-covered ground.

To improve the drainage efficiency, a water extracting machine is employed and equipped with a water pump which is in direct contact with the water in soil. However, the soil contains, in addition to moisture, a large amount of sediment impurities that will cause serious wear and blockage to the structure of the pump. Moreover, water on the surface of soil and penetrating into the soil can be hardly drained by means of the water pump.

SUMMARY

Therefore, an object of the disclosure is to provide a soil drainage device that can alleviate at least one of the drawbacks of the prior art.

According to the disclosure, the soil drainage device includes a host, at least one water collecting assembly and a piping unit. The host includes a host housing defining a control chamber therein, a control module disposed in the control chamber, and an air pump disposed in the control chamber and coupled with the control module to be operable for pushing air. The water collecting assembly includes an assembly housing having a surrounding wall which defines therein a water collecting chamber and a water reservoir chamber that is disposed under the water collecting chamber. The assembly housing has an upper penetrating bore for entering of water into the water collecting chamber from an upper end thereof, and a plurality of openings formed through the surrounding wall for laterally entering of water into the water collecting chamber. A filter unit includes first and second filter members disposed on the assembly housing to respectively cover the upper penetrating bore and the openings. A water level switch is disposed in the water reservoir chamber and is coupled with the control module. A valve member is disposed to regulate flow of water from the water collectins chamber into the water reservoir chamber. The piping unit includes an air intake pipe in spatial communication between the control chamber and ambient air, at least one water draining pipe in spatial communication between the water reservoir chamber of the water collecting assembly and outside thereof, and at least one air conducting pipe disposed to introduce compressed air from the air pump into the water reservoir chamber to forma pressure in the water reservoir chamber so as to force water flow out through the water draining pipe.

BRIEF DESCRIPTION OF THE DRAWINGS

Other features and advantages of the disclosure will become apparent in the following detailed description of the embodiments with reference to the accompanying drawings, of which.

Figure 3:
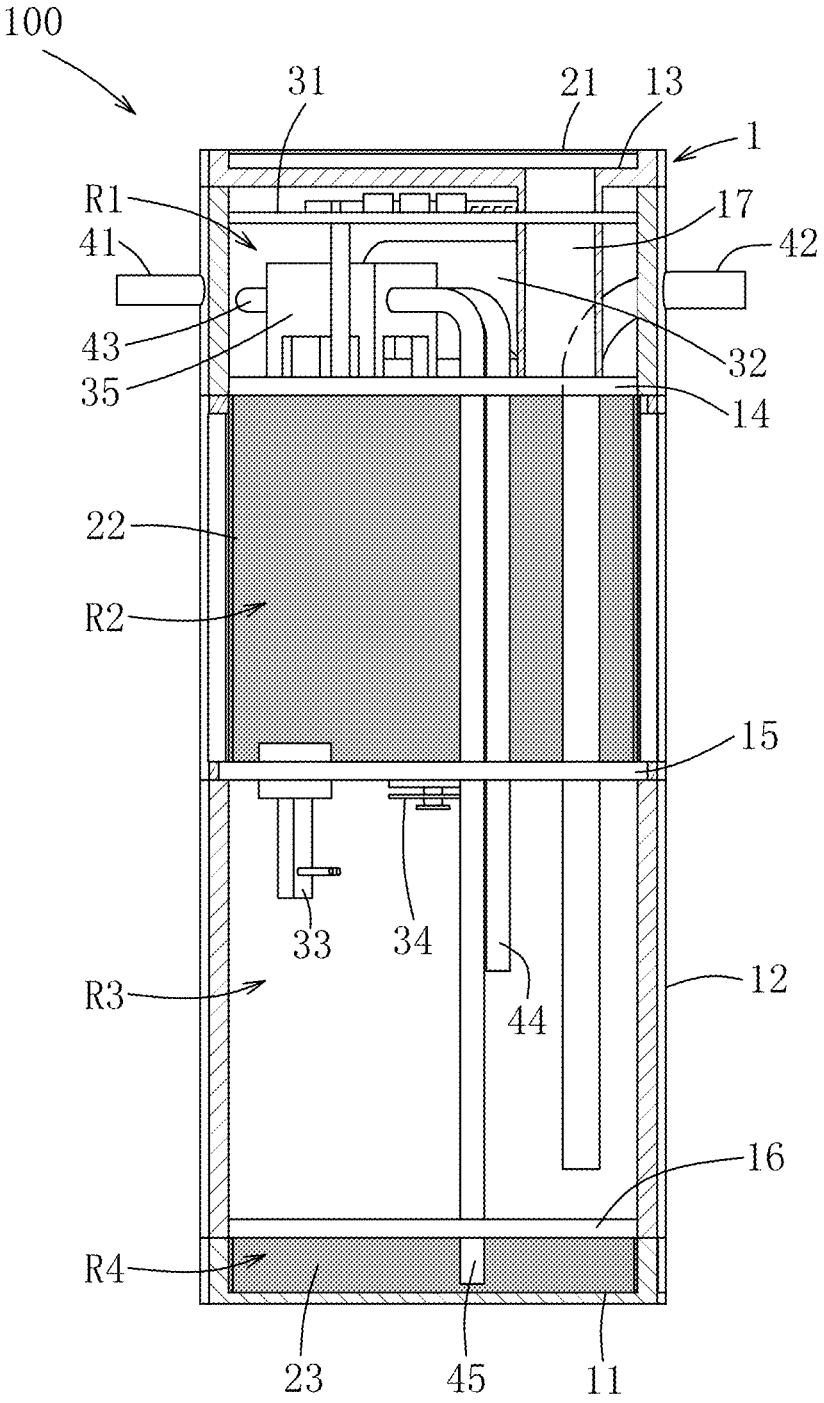
Figure 4:
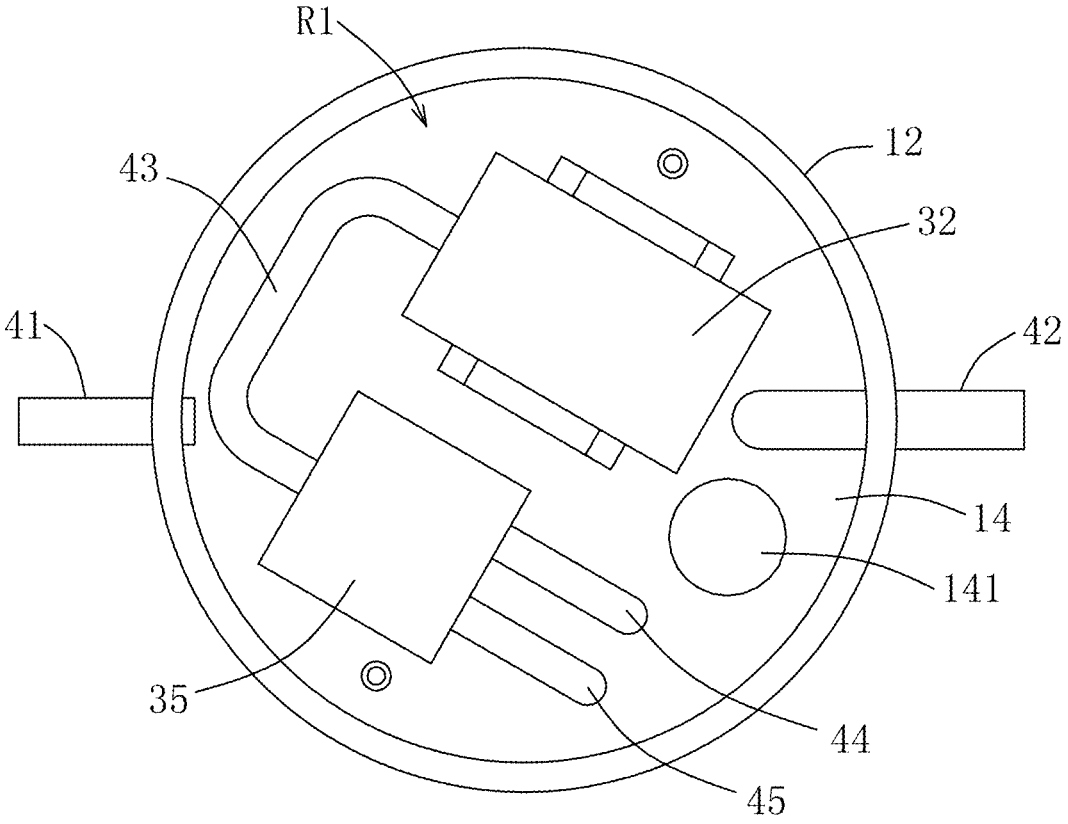
Figure 5:
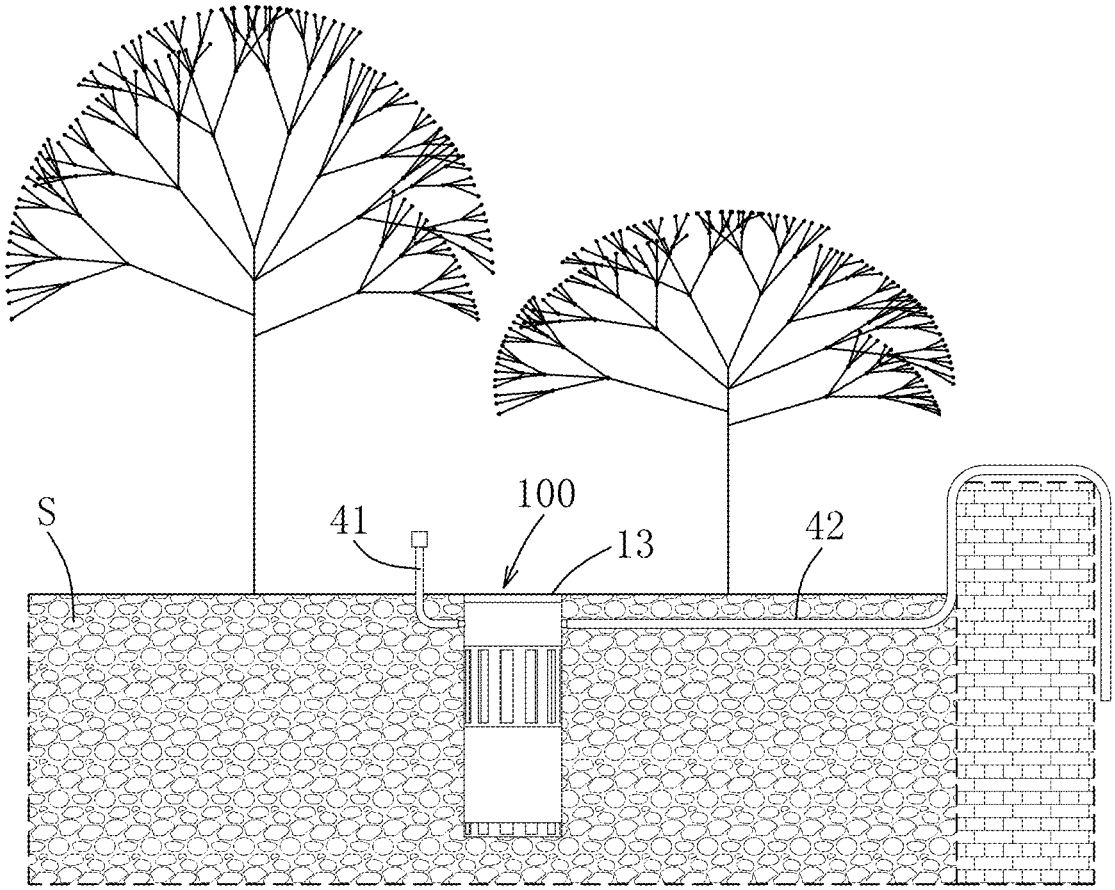
Figure 6:
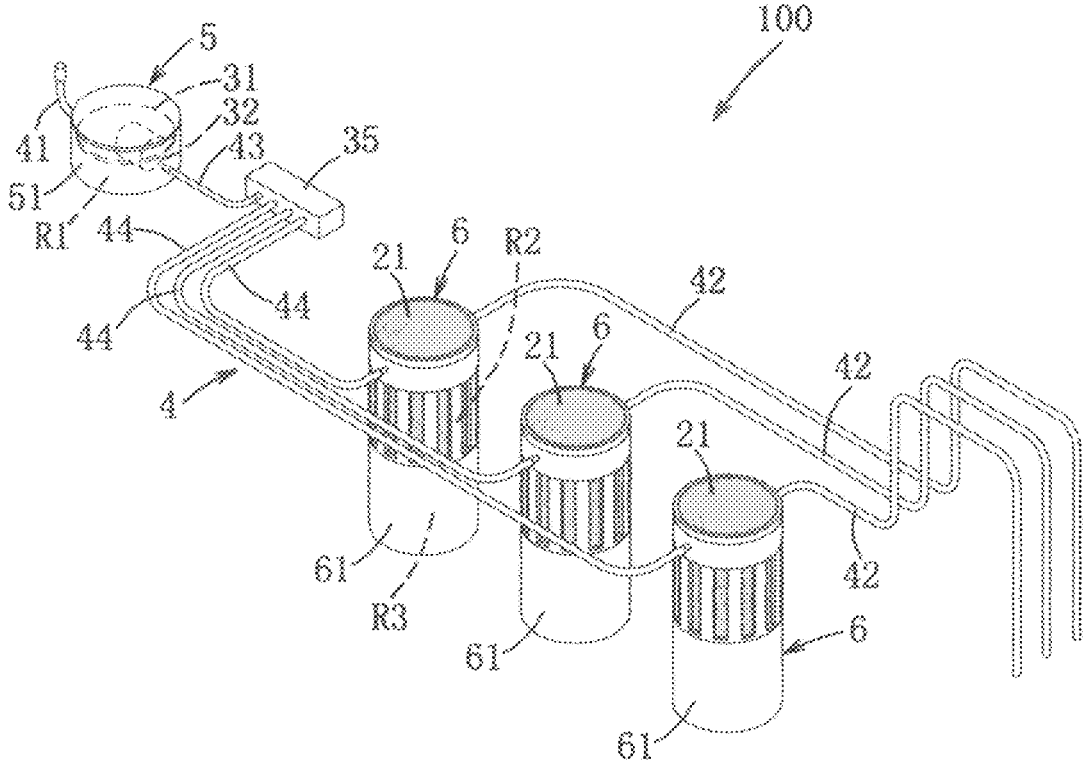
Figure 7:
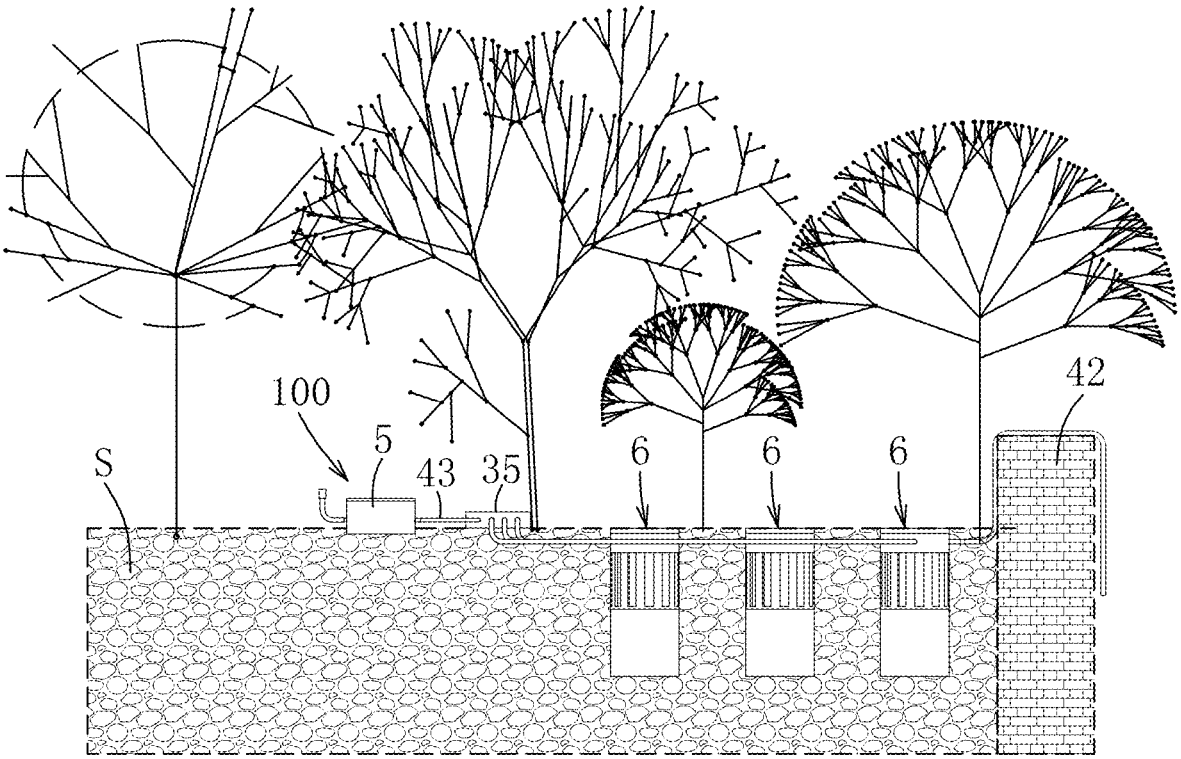

FIG. is an exploded perspective view of the embodiment;

FIG. 3 is a schematic sectional view of the embodiment;

FIG. 4 is a schematic top view of the embodiment, with parts thereof removed;

FIG. 5 is a schematic view of the embodiment in a state of use;

FIG. 6 is a perspective view illustrating another embodiment of the soil drainage device according to the disclosure; and FIG. 7 is a schematic view of the embodiment of FIG. 6 in a state of use.

DETAILED DESCRIPTION

Before the disclosure is described in greater detail, it should be noted that where considered appropriate, reference numerals or terminal portions of reference numerals have been repeated among the figures to indicate corresponding or analogous elements, which may optionally have similar characteristics.

Referring to FIGS. 1 to 4, an embodiment of a soil drainage device 100 according to the disclosure includes a machine housing 1, a filter unit 2, an air compressor unit 3 and a piping unit 4.

The machine housing 1 has a host housing 51 and an assembly housing 61 integrally formed with each other as a one-single piece in this embodiment. Specifically, the machine housing 1 includes a bottom wall 11, a surrounding wall 12 extending upwardly from a periphery of the bottom wall 11 and terminating at an upper surrounding edge, an upper cover wall 13 disposed on and covering the upper surrounding edge of the surrounding wall 12, and first, second and third partition walls 14, 15, 16 disposed within the surrounding wall 12. The first partition wall and the upper cover wall 13 cooperate with the surrounding wall 12 to serve as the host housing 51 which defines a control chamber (R1) therein. The first partition wall 14 and the bottom wall 11 cooperate with the surrounding wall 12 to serve as the assembly housing 61 under the host housing 51. More particularly, the first and second partition walls 14, 15 cooperate with the surrounding wall 12 to define a water collecting chamber (R2) thereamong. The second and third partition walls 15, 16 cooperate with the surrounding wall 12 to define a water reservoir chamber (R3) thereamong under the water collecting chamber (R2). The third partition wall 16 and the bottom wall 11 cooperate with the surrounding wall 12 to define an air introducing chamber (R4) thereamong under the water reservoir chamber (R3). The upper cover wall 13 is formed with an upper penetrating bore 131 extending therethrough for entering of water into the machine housing 1 from an upper end thereof. The first partition wall 14 is formed with a first through bore 141 extending therethrough. A connecting pipe interconnects the upper penetrating and first through bores 131, 141 to permit water entering from the upper penetrating bore 131 to flow into the water collecting chamber (R2). The second partition wall 15 is formed with a second through bore 151 to make spatial communication between the water collecting chamber (R2) and the water reservoir chamber (R3). The surrounding wall 12 has a plurality of openings 121 formed therethrough to make spatial communication between the water collecting-chamber (R2) and outside thereof for laterally entering of water into the water collecting chamber (R2), and a plurality of slots 122 formed therethrough to make spatial communication between the air introducing chamber (R4) and outside thereof.

The filter unit 2 includes a first filter member 21 disposed upon the upper cover wall 13 to cover the upper penetrating bore 131, a second filter member 22 disposed on and inwardly of the surrounding wall 12 in the water collecting chamber (R2) to cover the openings 121, and a third filter member 23 disposed on and inwardly of the surrounding wall 12 in the air introducing chamber (R4) to cover the slots 122.

The air compressor unit 3 includes a control module 31 disposed in the control chamber (R1), an air pump 32 disposed in the control chamber (R1) and coupled with the control module 31 to be operable for pushing air, a water level switch 33 disposed in the water reservoir chamber (R3) and coupled with the control module 31, a valve member 34 disposed to regulate flow of water from the second through bore 151 into the water reservoir chamber (R3), and a shift module 35 disposed in the control chamber (R1) and coupled with the control module 31. In this embodiment, the control module 31 has a wireless signal receiver (not shown) for receiving a wireless control signal in a known manner, and is programmed to control an operating time of the air pump 32.

The piping unit 4 includes an air intake pipe 41 in spatial communication between the control chamber (R1) and ambient air, a water draining pipe 42 in spatial communication between the water reservoir chamber (R3) and outside thereof, a connecting conduit 43 interconnecting the air pump 32 and the shift module 35, an air conducting pipe 44 connected with the shift module 35 to introduce compressed air from the air pump 32 into the water reservoir chamber (R3) to form a pressure in the water reservoir chamber (R3) so as to force water flow out through the water draining pipe 42, and an air introducing pipe 45 connected with the shift module 35 to introduce the air into the air introducing chamber (R4). The shift module 35 is operable to shift between a draining mode where the air pump 32 is in air communication with the air conducting pipe 44, and an air introducing mode where the air pump 32 is in air communication with the air introducing pipe 45.

With reference to FIG. 5, in use, the soil drainage device 100 of this embodiment is embedded in soil (S) with the upper cover wall 13 placed near the soil surface and an end of the air intake pipe 41 projecting out of the soil (S) for entry of air into the control chamber (R1). An end of the water draining pipe 42 extends to a water discharging container, such as a ditch, a pool or other reservoir. In operation, ponding water on the soil surface is filtered by the first filter member 21 and flows into the water collecting chamber (R2) from the upper penetrating bore 131 and through the connecting pipe 17. Water in the water collecting chamber (R2) then flows into and is stored in the water reservoir chamber (R3) through the second through bore 151. On the other hand, water in the soil (S) is filtered by the second filter member 22 and enters the water collecting chamber (R2) through the openings 121, and hence flows into and is stored in the water reservoir chamber (R3) through the second through bore 151. With the first and second filter members 21, 22, sediment impurities in water can be removed and prevented from entering the device 100. Subsequently, the water level switch 33 detects the water level in the water reservoir chamber (R3), and sends a signal to the control module 31 at a predetermined water level. The air pump 32 is actuated by means of the control module 31 based on the signal of a draining mode. For example, in accordance with climate and environment of soil, the air pump 32 is actuated immediately when the water level switch 33 detects a predetermined full water level, such as in wet climate and upon less water requirement of plants. Alternatively, the actuation of the air pump 32 may be delayed for a predetermined time after the signal is received by the control module 31, such as in dry climate and upon higher water requirement of plants. With the wireless signal receiver of the control module 31, a user can edit and set the draining mode by means of a wireless communicating device such as a cell phone or a computer. It is also operable in a wire connection. In the draining mode, the shift module 35 is shifted by the control module to make the air communication between the air conducting pipe 44 and the connecting conduit 43 such that the compressed air from the air pump 32 is introduced into the water reservoir chamber (R3). At the same time, the valve member 34 is controlled to close the second through bore 151 to convert the water reservoir chamber (R3) to a closed compartment. Thus, the compressed air introduced in the water reservoir chamber (R3) produces a pressure to facilitate discharging of the water out of the water reservoir chamber (R3) through the water draining pipe 42.

The air pump 32 is actuated for a predetermined operating time given by the control module 31, and is stopped to avoid overrunning thereof caused by occurrence of draining blockage or other accidents so as to prevent damage to the air pump 32. The operating time is predetermined in accordance with the volume of the water reservoir chamber (R3) and the drainage rate and is set in the control module 31. In addition, the air pump 32 is actuated when the shift module 35 is shifted to an air introducing mode, where the air communication between the air introducing pipe 45 and the connecting conduit 43 is made for a predetermined time given by the control module 31. In this mode, the air pushed by the air pump 32 flows to the air introducing chamber (R4), and is introduced in the soil (S) through the third filter member 23 and the slots 122 for providing oxygen to roots of plants.

In this embodiment, the shift module 35 is provided with two solenoid valves (not shown) to respectively regulate the air communication between the air conducting pipe 44 or the air introducing pipe 45 and the connecting conduit 43. Alternatively, in a modified embodiment, the water drainage function is performed without providing the air introducing chamber (R4), the shift module 35, the connecting conduit 43 and the air introducing pipe 45. That is, in the machine housing 1, the third partition wall 16 can be dispensed with, and the surrounding wall 12 is not needed to have the slots 122. The air conducting pipe 44 can be directly connected with the air pump 32.

Referring to FIGS. 6 and 7, the soil drainage device 100 of another embodiment is adapted for a large range of soil (S). The soil drainage device 100 of such embodiment includes a host 5, a plurality of water collecting assemblies 6 and a piping unit 4.

The host 5 includes a host housing 51 defining a control chamber (R1) therein, a control module 31 (with reference to FIG. 2) disposed in the control chamber (R1), an air pump 32 (with reference to FIG. 2) disposed in the control chamber (R1) and coupled with the control module 31 to be operable for pushing air, and a shift module 35 coupled with the control module 31. The shift module 35 can be disposed inside or outside the host housing 51 as required.

Figure 1:
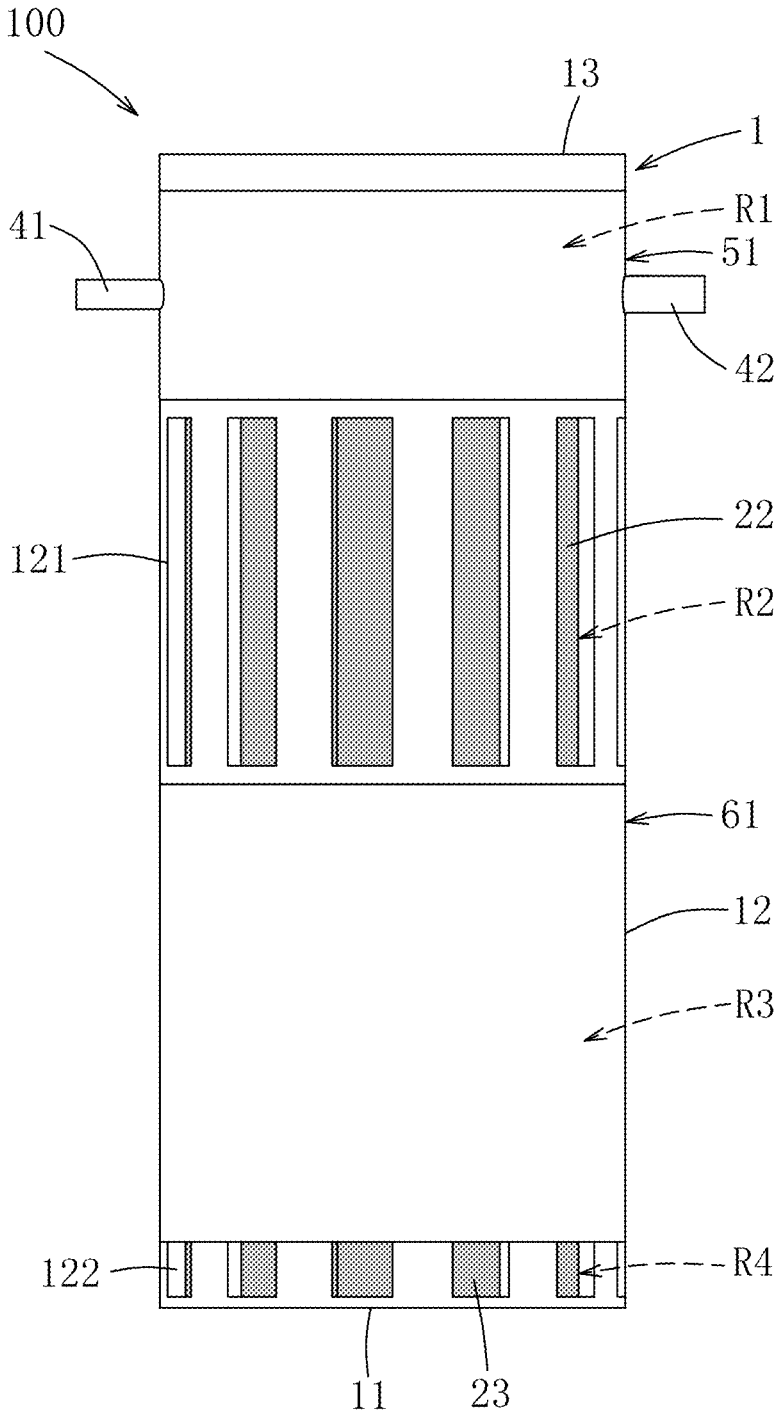
FIG. 1 is a schematic side view illustrating an embodiment of a soil drainage device according to the disclosure.
Figure 2:
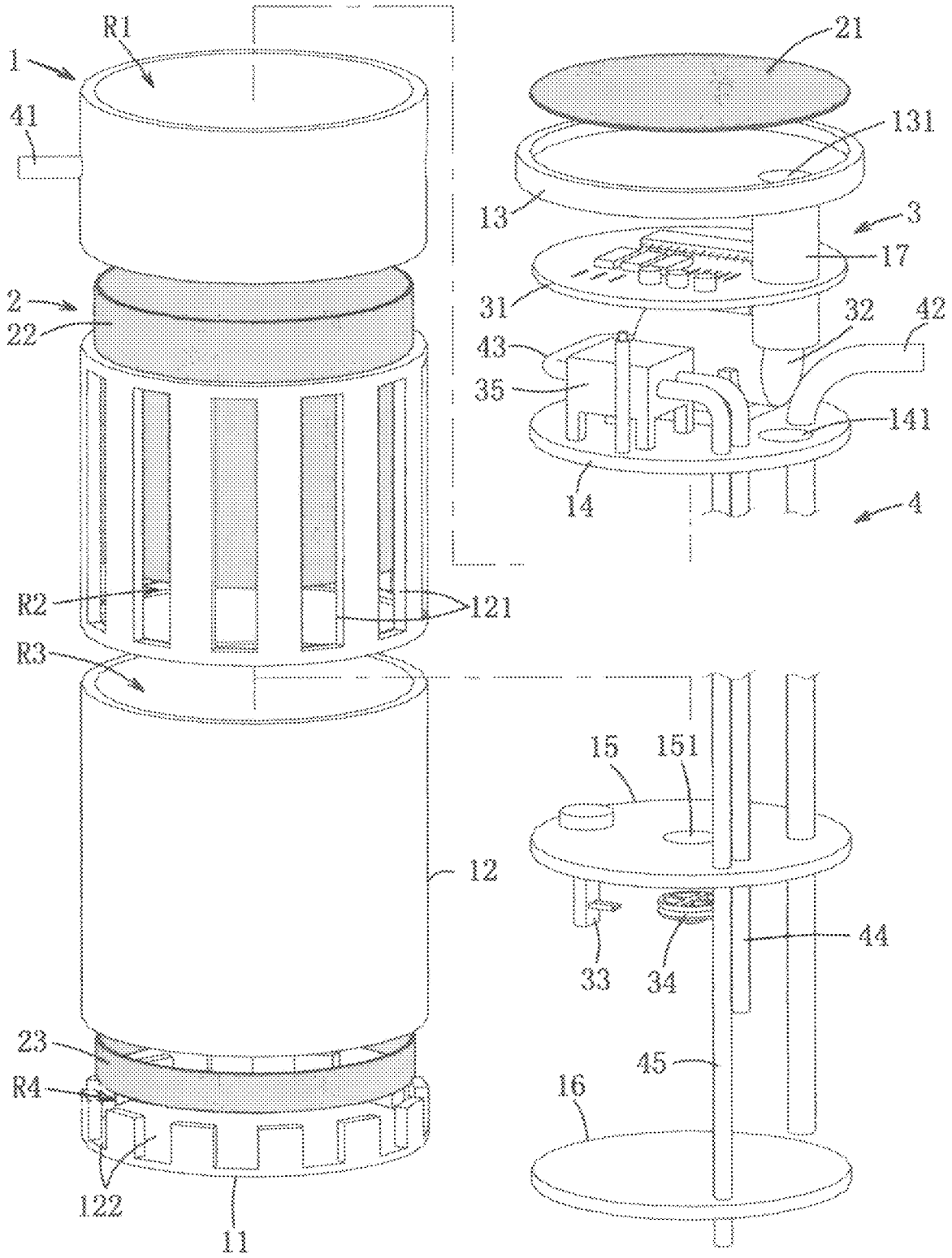

Taking FIGS. 2 and 3 as extra reference, each water collecting assembly 6 includes an assembly housing 61, a filter unit 2, a water level switch 33 and a valve member 34. The filter unit 2, the water level switch 33 and the valve member 34 are similar to those in the previous embodiment. The assembly housing 61 includes a bottom wall 11, a surrounding wall 12 extending upwardly from a periphery of the bottom wall 11 and terminating at an upper surrounding edge, an upper cover wall 13 disposed on and covering the upper surrounding edge of the surrounding wall 12, and a middle partition wall 15 (corresponding with the second partition wall 15 of the previous embodiment) disposed within the surrounding wall 12 such that the middle partition wall 15 and the upper cover wall 13 cooperate with the surrounding wall 12 to define a water collecting chamber (R2) thereamong, and the middle partition wall 15 and the bottom wall 11 cooperate with the surrounding wall 12 to at least define a water reservoir chamber (R3) thereamong. Similarly, the upper cover wall 13 is formed with an upper penetrating bore 131 extending therethrough. The middle partition wall 15 is formed with a through bore 151 to make spatial communication between the water collecting chamber (R2) and the water reservoir chamber (R3). The surrounding wall 12 has a plurality of openings 121 formed therethrough to make spatial communication between the water collecting chamber (R2) and outside thereof. Specifically, the first partition wall 14 of the previous embodiment is dispensed with. FIGS. 6 and 7 illustrate the assembly housing 61 which does not have an air introducing chamber (R4) therein. Alternatively, in a modified embodiment, each assembly housing 61 may have a lower partition wall 16 (corresponding with the third partition wall 16 of the previous embodiment) and an air introducing chamber (R4) under the water reservoir chamber (R3). Additionally, the surrounding wall 12 may further have a plurality of slots (corresponding with the slots 122 of the previous embodiment). The filter unit 2 may further include a third filter member (corresponding with the third filter member 23 of the previous embodiment).

In this embodiment, the piping unit 4 includes an air intake pipe 41 in spatial communication between the control chamber (R1) and ambient air, a connecting conduit 43 interconnecting the air pump 32 and the shift module 35, a plurality of air conducting pipes 44 each interconnecting the shift module 35 and the respective water collecting assembly 6, and a plurality of water draining pipes 42 each in spatial communication between the water reservoir chamber (R3) of the respective water collecting assembly 6 and outside thereof. Each air conducting pipe 44 is in spatial connection with the water reservoir chamber (R3) of the respective water collecting assembly 6 to introduce compressed air from the air pump 32 into the water reservoir chamber (R3) to form a pressure in the water reservoir chamber (R3). The shift module 35 is interposed between the connecting conduit 43 and a respective one of the air conducting pipes 44 to shift between an air communicating mode where an air communication therebetween is made, and an air interrupting mode where the air communication is interrupted. The shift module 35 is provided with a plurality of solenoid valves (not shown) to respectively regulate the air communication between the air conducting pipes 44 and the connecting conduit 43. As mentioned above, in a modified embodiment, each water collecting assembly 6 may have an air introducing chamber (R4). In such modified embodiment, the piping unit 4 further includes a plurality of air introducing pipes 45 (with reference to FIG. 3), each of which is connected with the shift module 35 and the respective water collecting assembly 6 to introduce the air into the air introducing chamber (R4). The shift module 35 is operable to shift between an air communicating mode where an air communication between each air introducing pipe 45 and the connecting conduit 43 is made, and an air interrupting mode where the air communication is interrupted. That is, the shift module 35 further has a plurality of solenoid valves (not shown) to respectively regulate the air communication between the air introducing pipes 45 and the connecting conduit 43. Since the connections between the air introducing pipes 45 and the shift module 35 and between the air introducing pipes 45 and the respective water collecting assemblies 6 are similar to those in the previous embodiment shown in FIG. 3, a detail description and illustration thereof are omitted for the sake of brevity.

Specifically, in this embodiment, a single host 5 and a plurality of water collecting assemblies 6 are provided to form a soil drainage device 100 for being used in a large area of soil (S), which improves water drainage efficiency and dispenses with a cost of preparing extra hosts.

As illustrated, the soil drainage device 100 of the disclosure is embedded in soil (S), and collects water on the soil surface and in the soil by virtue of gravity and penetration. The water collected in the machine housing can be extracted by means of compressed air so as to achieve great soil drainage efficiency. Moreover, air is introduced in the soil (S) to provide oxygen to roots of plants.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A soil drainage device comprising:

a machine housing including a bottom wall, a surrounding wall extending upwardly from a periphery of said bottom wall and terminating at an upper surrounding edge, an upper cover wall disposed on and covering said upper surrounding edge of said surrounding wall, and first and second partition walls disposed within said surrounding wall such that said first partition wall and said upper cover wall cooperate with said surrounding wall to define a control chamber thereamong, said first and second partition walls cooperate with said surrounding wall to define a water collecting chamber thereamong, and said second partition wall and said bottom wall cooperate with said surrounding wall to at least define a water reservoir chamber thereamong, said upper cover wall being formed with an upper penetrating bore extending therethrough, said first partition wall being formed with a first through bore extending therethrough, said machine housing further including a connecting pipe interconnecting said upper penetrating and first through bores to permit water entering from said upper penetrating bore to flow into said water collecting chamber, said second partition wall being formed with a second through bore to make spatial communication between said water collecting chamber and said water reservoir chamber, said surrounding wall having a plurality of openings formed therethrough to make spatial communication between said water collecting chamber and outside thereof;

a filter unit including a first filter member disposed upon said upper cover wall to cover said upper penetrating bore, and a second filter member disposed on and inwardly of said surrounding wall in said water collecting chamber to cover said openings;

an air compressor unit including a control module disposed in said control chamber, an air pump disposed in said control chamber and coupled with said control module to be operable for pushing air, a water level switch disposed in said water reservoir chamber and coupled with said control module, and a valve member disposed to regulate flow of water from said second through bore into said water reservoir chamber; and a piping unit including an air intake pipe in spatial communication between said control chamber and ambient air, a water draining pipe in spatial communication between said water reservoir chamber and outside thereof, and an air conducting pipe disposed to introduce compressed air from said air pump into said water reservoir chamber to form a pressure in said water reservoir chamber so as to force water flow out through said water draining pipe.

2. The soil drainage device as claimed in claim 1, wherein said machine housing further includes a third partition wall disposed within said surrounding wall and interposed between said second partition wall and said bottom wall such that said second and third partition walls cooperate with said surrounding wall to define said water reservoir chamber thereamong, and said third partition wall and said bottom wall cooperate with said surrounding wall to define an air introducing chamber thereamong, said surrounding wall further having a plurality of slots formed therethrough to make spatial communication between said air introducing chamber and outside thereof, said filter unit further including a third filter member disposed on and inwardly of said surrounding wall in said air introducing chamber to cover said slots, said air compressor unit further including a shift module disposed in said control chamber and coupled with said control module, said piping unit further including a connecting conduit interconnecting said air pump and said shift module, and an air introducing pipe connected with said shift module to introduce the air into said air introducing chamber, said air conducting pipe being connected with said shift module such that said shift module is operable to shift between a draining mode where said air pump is in air communication with said air conducting pipe, and an air introducing mode where said air pump is in air communication with said air introducing pipe.

3. The soil drainage device as claimed in claim 1, wherein said control module has a wireless signal receiver for receiving a wireless control signal.

4. The soil drainage device as claimed in claim 1, wherein said control module is programmed to control an operating time of said air pump.

5. A soil drainage device comprising:

a host including a host housing defining a control chamber therein, a control module disposed in said control chamber, an air pump disposed in said control chamber and coupled with said control module to be operable for pushing air, and a shift module coupled with said control module;

a plurality of water collecting assemblies, each including an assembly housing including a bottom wall, a surrounding wall extending upwardly from a periphery of said bottom wall and terminating at an upper surrounding edge, an upper cover wall disposed on and covering said upper surrounding edge of said surrounding wall, and a middle partition wall disposed within said surrounding wall such that said middle partition wall and said upper cover wall cooperate with said surrounding wall to define a water collecting chamber thereamong, and said middle partition wall and said bottom wall cooperate with said surrounding wall to at least define a water reservoir chamber thereamong, said upper cover wall being formed with an upper penetrating bore extending therethrough, said middle partition wall being formed with a through bore to make spatial communication between said water collecting chamber and said water reservoir chamber, said surrounding wall having a plurality of openings formed therethrough to make spatial communication between said water collecting chamber and outside thereof, a filter unit including a first filter member disposed upon said upper cover wall to cover said upper penetrating bore, and a second filter member disposed on and inwardly of said surrounding wall in said water collecting chamber to cover said openings, a water level switch disposed in said water reservoir chamber and coupled with said control module, and a valve member disposed to regulate flow of water from said through bore into said water reservoir chamber; and a piping unit including an air intake pipe in spatial communication between said control chamber and ambient air, a connecting conduit interconnecting said air pump and said shift module, a plurality of air conducting pipes each interconnecting said shift module and a respective one of said water collecting assemblies, and a plurality of water draining pipes each in spatial communication between said water reservoir chamber of the respective one of said water collecting assemblies and outside thereof, each of said air conducting pipes being in spatial connection with said water reservoir chamber to introduce compressed air from said air pump into said water reservoir chamber to form a pressure in said water reservoir chamber, said shift module being interposed between said connecting conduit and a respective one of said air conducting pipes to shift between an air communicating mode where air communication between said connecting conduit and said respective one of said air conducting pipes is made, and an air interrupting mode where the air communication is interrupted.

6. The soil drainage device as claimed in claim 5, wherein said assembly housing of each of said water collecting assemblies further includes a lower partition wall disposed within said surrounding wall and interposed between said middle partition wall and said bottom wall such that said lower and middle partition walls cooperate with said surrounding wall to define said water reservoir chamber thereamong, and said lower partition wall and said bottom wall cooperate with said surrounding wall to define an air introducing chamber thereamong, said surrounding wall further having a plurality of slots formed therethrough to make a spatial communication between said air introducing chamber and outside thereof, said filter unit further including a third filter member disposed on and inwardly of said surrounding wall in said air introducing chamber to cover said slots, said piping unit further including a plurality of air introducing pipes, each of said plurality of air introducing pipes being connected with said shift module and the respective one of said water collecting assemblies to introduce the air into said air introducing chamber of the respective water collecting assembly, said shift module being operable to shift between an air communicating mode where air communication between each of said air introducing pipes and said connecting conduit is made, and an air interrupting mode where the air communication is interrupted.

7. The soil drainage device as claimed in claim 5, wherein said control module has a wireless signal receiver for receiving a wireless control signal.

8. The soil drainage device as claimed in claim 5, wherein said control module is programmed to control an operating time of said air pump.

9. A soil drainage device comprising:

a host including a host housing defining a control chamber therein, a control module disposed in said control chamber, and an air pump disposed in said control chamber and coupled with said control module to be operable for pushing air;

at least one water collecting assembly including an assembly housing having a surrounding wall which defines therein a water collecting chamber and a water reservoir chamber that is disposed under said water collecting chamber, said assembly housing having an upper penetrating bore for entering of water into said water collecting chamber from an upper end thereof, and a plurality of openings formed through said surrounding wall for laterally entering of water into said water collecting chamber, a filter unit including first and second filter members disposed on said assembly housing to respectively cover said upper penetrating bore and said openings, a water level switch disposed in said water reservoir chamber and coupled with said control module, and a valve member disposed to regulate flow of water from said water collecting chamber into said water reservoir chamber; and a piping unit including an air intake pipe in spatial communication between said control chamber and ambient air, at least one water draining pipe in spatial communication between said water reservoir chamber of said water collecting assembly and outside thereof, and at least one air conducting pipe disposed to introduce compressed air from said air pump into said water reservoir chamber to form a pressure in said water reservoir chamber so as to force water flow out through said at least one water draining pipe.

* * * * *